US008669222B2

(12) United States Patent
Motsenbocker

(10) Patent No.: US 8,669,222 B2
(45) Date of Patent: Mar. 11, 2014

(54) LOW VOC COMPOSITION FOR RELEASING ADHERENT DEPOSITS FROM A NONPOROUS SURFACE

(76) Inventor: Gregg Motsenbocker, San Diego, CA (US)

( * ) Notice: Subject to any disclaimer, the term of this patent is extended or adjusted under 35 U.S.C. 154(b) by 0 days.

(21) Appl. No.: 13/445,876

(22) Filed: Apr. 12, 2012

(65) Prior Publication Data

US 2012/0196788 A1 Aug. 2, 2012

Related U.S. Application Data

(63) Continuation-in-part of application No. 11/864,959, filed on Sep. 29, 2007, now abandoned.

(51) Int. Cl.
*C11D 17/00* (2006.01)

(52) U.S. Cl.
USPC ..... 510/406; 510/407; 510/412; 510/463

(58) Field of Classification Search
None
See application file for complete search history.

(56) References Cited

U.S. PATENT DOCUMENTS 4,306,989 A * 12/1981 Motsenbocker ..... 510/200
5,750,488 A * 5/1998 Haskell et al. ..... 510/412

* cited by examiner

*Primary Examiner* — Necholus Ogden, Jr.
(74) *Attorney, Agent, or Firm* — Steven W. Webb

(57) ABSTRACT

Compositions and methods for release of adherent deposits from nonporous surfaces and substrates are provided. The compositions are low volatile organic compound (low VOC) compositions, solutions or mixtures that can be applied in a form that clings to the underlying surface while it is working. Adherent deposits removed using the compositions include grease and oil, and printers ink. The compositions may be used on any nonporous surface or substrate including metals, ceramics and plastics, without harming the surface or substrate. The composition may contain a thixotropic agent to act as an anti-shearing agent.

2 Claims, 1 Drawing Sheet

EXAMPLES A to H

| Reagent | A | B | C | D | E | F | G | H |
|---|---|---|---|---|---|---|---|---|
| Calumet 400-500 | 89.0 | 87.0 | 91.0 | 89.0 | 92.0 | 85.0 | 83.0 | 84.0 |
| Methylal | 2.0 | 2.0 | 0 | 0 | 6.2 | 6.2 | 6.2 | 2.0 |
| Ethanol | 0 | 0 | 0 | 0 | 0.8 | 0.8 | 0.8 | 0 |
| Belmay Citrus | 1.0 | 1.0 | 1.0 | 1.0 | 1.0 | 1.0 | 1.0 | 1.0 |
| TRITON™ X-100 | 0 | 2.0 | 0 | 2.0 | 0 | 0 | 2.0 | 5.0 |
| Water | 0 | 0 | 0 | 0 | 0 | 0 | 0 | 0 |
| BUTYLCELLO-SOLVE™ | 0 | 0 | 0 | 0 | 0 | 0 | 0 | 0 |
| n-Propyl Bromide | 8.0 | 8.0 | 8.0 | 8.0 | 0 | 7.0 | 7.0 | 8.0 |

EXAMPLES I to P

| Reagent | I | J | K | L | M | N | O | P |
|---|---|---|---|---|---|---|---|---|
| Calumet 400-500 | 91.0 | 95.7 | 91.0 | 84.0 | 30.0 | 0 | 0 | 0 |
| Methylal | 0 | 3.0 | 6.2 | 10.0 | 10.0 | 19.0 | 11.9 | 12.4 |
| Ethanol | 0 | 0.3 | 0.8 | 5.0 | 10.0 | 1.9 | 1.2 | 1.2 |
| Belmay Citrus | 1.0 | 1.0 | 1.0 | 1.0 | 1.0 | 1.0 | 1.0 | 1.0 |
| TRITON™ X-100 | 5.0 | 0 | 1.0 | 0 | 10.0 | 2.9 | 2.7 | 12.4 |
| Water | 0 | 0 | 0 | 0 | 29.0 | 75.2 | 71.3 | 60.7 |
| BUTYLCELLO-SOLVE™ | 0 | 0 | 0 | 0 | 10 | 0 | 11.9 | 12.4 |
| n-Propyl Bromide | 3.0 | 0 | 8.0 | 8.0 | 0 | 0 | 0 | 0 |

- VALUES ARE GIVEN AS WEIGHT PERCENTAGES -

EXAMPLES A to H

| Reagent | A | B | C | D | E | F | G | H |
|---|---|---|---|---|---|---|---|---|
| Calumet 400-500 | 89.0 | 87.0 | 91.0 | 89.0 | 92.0 | 85.0 | 83.0 | 84.0 |
| Methylal | 2.0 | 2.0 | 0 | 0 | 6.2 | 6.2 | 6.2 | 2.0 |
| Ethanol | 0 | 0 | 0 | 0 | 0.8 | 0.8 | 0.8 | 0 |
| Belmay Citrus | 1.0 | 1.0 | 1.0 | 1.0 | 1.0 | 1.0 | 1.0 | 1.0 |
| TRITON™ X-100 | 0 | 2.0 | 0 | 2.0 | 0 | 0 | 2.0 | 5.0 |
| Water | 0 | 0 | 0 | 0 | 0 | 0 | 0 | 0 |
| BUTYLCELLO-SOLVE™ | 0 | 0 | 0 | 0 | 0 | 0 | 0 | 0 |
| n-Propyl Bromide | 8.0 | 8.0 | 8.0 | 8.0 | 0 | 7.0 | 7.0 | 8.0 |

EXAMPLES I to P

| Reagent | I | J | K | L | M | N | O | P |
|---|---|---|---|---|---|---|---|---|
| Calumet 400-500 | 91.0 | 95.7 | 91.0 | 84.0 | 30.0 | 0 | 0 | 0 |
| Methylal | 0 | 3.0 | 6.2 | 10.0 | 10.0 | 19.0 | 11.9 | 12.4 |
| Ethanol | 0 | 0.3 | 0.8 | 5.0 | 10.0 | 1.9 | 1.2 | 1.2 |
| Belmay Citrus | 1.0 | 1.0 | 1.0 | 1.0 | 1.0 | 1.0 | 1.0 | 1.0 |
| TRITON™ X-100 | 5.0 | 0 | 1.0 | 0 | 10.0 | 2.9 | 2.7 | 12.4 |
| Water | 0 | 0 | 0 | 0 | 29.0 | 75.2 | 71.3 | 60.7 |
| BUTYLCELLO-SOLVE™ | 0 | 0 | 0 | 0 | 10 | 0 | 11.9 | 12.4 |
| n-Propyl Bromide | 3.0 | 0 | 8.0 | 8.0 | 0 | 0 | 0 | 0 |

- VALUES ARE GIVEN AS WEIGHT PERCENTAGES -

LOW VOC COMPOSITION FOR RELEASING ADHERENT DEPOSITS FROM A NONPOROUS SURFACE

RELATED APPLICATIONS

This application is a Continuation-In-Part of U.S. patent application Ser. No. 11/864,959, filed on Sep. 29, 2007 now abandoned.

FIELD OF THE INVENTION

The field of invention relates to compositions and methods for releasing adherent deposits from surfaces and substrates. In particular, low volatile organic compound (low VOC) compositions specifically designed to be applied to nonporous surfaces are provided.

BACKGROUND OF THE INVENTION

This application is based on a previous application Ser. No. 09/678,619, now U.S. Pat. No. 6,929,702. Much of the material of this application is repeated from that application, and not included by reference.

The release of adherent deposits (dirt, grease and the like) from surfaces and substrates without damaging the surface or substrate is a continuing problem. Currently available compositions and methods suffer from a limited range of applicability and effectiveness, in that they remove only certain types of adherent deposits from particular surfaces and substrates.

Many currently available solvent and water based compositions for cleaning adherent deposits from surfaces and substrates do not meet governmental regulations with respect to the percentage of volatile organic compounds (VOCs) present in the composition.

It is a central object of this invention to provide low VOC compositions for removing adherent deposits from surfaces and substrates that are effective on a variety of adherent deposits and are widely applicable for all surfaces and substrates.

SUMMARY OF THE INVENTION

Provided herein is a compositions and method for releasing grease and other adherent deposits from nonporous and metal surfaces, such as automobile brakes, lawn mowers, motorcycles, and various engine parts. The present compositions provided herein contain an exempt volatile organic compound (exempt VOC) or a nonvolatile organic compound (non-VOC) that is able to safely remove adherent deposits from metal surfaces and substrates, such as composite plastics, ceramics, wiring, rubber hoses, painted or unpainted, fiberglass, and other hard surfaces.

Other compositions contain a first solvent that is able to remove adherent deposits from surfaces and substrates, and a carrier solvent, which is an exempt VOC or a non-VOC. In these compositions, the first solvent is from about 0.1% to about 50.0 weight % and the exempt VOC or non-VOC carrier solvent is from about 50.0% to about 99.9 weight %.

Other compositions provided herein contain a first solvent that is able to remove adherent deposits from surfaces and substrates, a carrier solvent, which is an exempt VOC or a non-VOC, and at least one additive. In these compositions, the first solvent is from about 0.1% to about 50.0 weight %, the exempt VOC or non-VOC carrier solvent is from about 10.0% to about 99.9 weight %, and each additive is from 0% to about 20 weight %. Additives for use in the compositions and methods provided herein include, but are not limited to, second solvents, cleaners, surfactants, coupling agents, fragrances and thickeners.

In particular, the compositions provided herein contain a first solvent that is an acetal, ketal or ortho ester. For example, in certain compositions, the first solvent is methylal.

In these compositions, the carrier solvent is a petroleum distillate, in particular, Light Hydrotreated Petroleum Distillates.

In these compositions, the first solvent is from about 0.1% to about 50.0 weight %; the carrier solvent is from about 10.0% to about 99.9 weight %; and at least one additive is selected from among a second solvent from about 0% to about 20.0 weight %; a cleaner from about 0% to about 20.0 weight %; a surfactant from about 0% to about 20.0 weight %; a coupling agent from about 0% to about 20.0 weight %; a fragrance from about 0% to about 20.0 weight %.

Certain compositions provided herein contain a first solvent that is methylal; a carrier solvent that is a Light Hydrotreated Petroleum Distillates; and, at least one additive that is a second solvent, a cleaner, a surfactant, a coupling agent, a fragrance or a thickener.

In these compositions, the first solvent is from about 0.1% to about 50.0 weight % methylal; the carrier solvent is from about 10.0% to about 99.9 weight % Light Hydrotreated Petroleum Distillates; the cleaner is from about 0% to about 20.0 weight % ethanol; and, the fragrance is from about 0% to about 20.0 weight %.

In particular, these compositions contain a first solvent that is 6.2% methylal; a carrier solvent that is 92.0% Light Hydrotreated Petroleum Distillates; a cleaner that is 0.8% ethanol; and, a fragrance that is 1.0%.

Other compositions contain a first solvent that is methylal; a carrier solvent that is a Light Hydrotreated Petroleum Distillates; and, at least one additive that is a second solvent, a surfactant or a fragrance.

In these compositions, the first solvent is from about 0.1% to about 50.0 weight % methylal; the carrier solvent is from about 10.0% to about 99.9 weight % Light Hydrotreated Petroleum Distillates; the second solvent is from about 0% to about 50.0 weight % n-propyl bromide; the surfactant is from about 0% to about 20.0 weight % TRITON® X-100 (polyethylene glycol mono(4-(1,1,3,3-tetramethylbutyl)phenyl) ether (also known as t-octylphenoxypolyethoxyethanol or polyoxyethylene (10) isooctylphenyl ether) or TRITON® XL-80N(C.sub.8-C.sub.10-alkyloxypolyethyleneoxy-polypropyleneoxyethanol); and, the fragrance is from about 0% to about 20.0 weight %.

In particular, these compositions contain a first solvent that is 2.0% methylal; a carrier solvent that is 84.0% Light Hydrotreated Petroleum Distillates; a second solvent that is 8.0% n-propyl bromide; a surfactant that is 5.0% TRITON® X-100 (polyoxyethylene (10) isooctylphenyl ether); and, a fragrance that is 1.0%.

Other compositions contain a first solvent that is methylal; a carrier solvent that is water; and, at least one additive that is selected from among second solvents, cleaners, surfactants, coupling agents and fragrances.

In these compositions, the first solvent is from about 0.1% to about 50.0 weight % methylal; the carrier solvent is from about 10.0% to about 99.9 weight % water; the cleaner is from about 0% to about 20.0 weight % ethanol; the surfactant is from about 0% to about 20.0 weight % TRITON® X-100 (polyoxyethylene (10) isooctylphenyl ether); the coupling agent is from about 0% to about 20.0 weight % BUTYL CELLOSOLVE® (2-butoxyethanol); and, the fragrance is from about 0% to about 20.0 weight %.

In particular, these compositions contain a first solvent that is 11.9 weight % methylal; a carrier solvent that is 71.3 weight % water; a cleaner that is 0.8 weight % ethanol; a surfactant that is 2.7 weight % TRITON® X-100 (polyoxyethylene (10) isooctylphenyl ether); a coupling agent that is 11.9 weight % BUTYL CELLOSOLVE® (2-butoxyethanol); and, a fragrance that is 1.0 weight %.

Certain of these compositions contain less than or equal to 50 weight % VOCs. Others contain less than or equal to 40 weight % VOCs. Others, less than or equal to 35 weight % VOCs. Others, less than or equal to 25 weight % VOCs. Others, less than or equal to 22 weight % VOCs. Others, less than or equal to 10 weight % VOCs. Others, less than or equal to 7 weight % VOCs. Others, less than or equal to 5 weight % VOCs. Others, less than or equal to 4 weight % VOCs. Others, less than or equal to 3 weight % VOCs.

The methods provided allow for the release of adherent deposits from surfaces and substrates by applying an exempt VOC or a non-VOC to the deposits and then removing the released deposits from the surface or substrate. Here, the exempt VOC or non-VOC is Light Hydrotreated Petroleum Distillates. The released deposits are physically removed by either a wiping or by directing a stream of water against the released deposits.

BRIEF DESCRIPTION OF THE FIGURES

FIG. 1. Table of Sample Compositions of the Invention

DETAILED DESCRIPTION OF THE EMBODIMENTS

The compositions provided herein release a wide variety of adherent deposits from surfaces and substrates. Adherent deposits are characterized by the formation of an adherent layer which is attached to a surface or substrate. It is the purpose of these compositions to reduce or eliminate the extent of attachment, so the adherent layer can be physically removed from the surface or substrate without damage to the surface or substrate, while also being safe for the individual and the environment.

Compositions useful for releasing adherent deposits from surfaces and substrates contain one or more exempt VOC or non-VOCs. Possible other compositions include a first solvent, an exempt VOC or non-VOC carrier solvent and optionally one or more additives. The various combinations of these solvents and additives affords low-VOC compositions useful for releasing adherent deposits.

(i) First Solvent

The first solvent should have good solvency for releasing adherent deposits from surfaces and substrates.

The first solvents can be aromatic hydrocarbon solvents. These aromatic hydrocarbon solvents include but are not limited to: benzene, toluene, xylenes, d-limonene, and others.

Other first solvents are acyclic and cyclic ketones. These acyclic and cyclic ketones include but are not limited to: pentanone, hexanone, cyclopentanone and cyclohexanone. Cyclohexanone is an especially useful first solvent in attacking inks and dyes.

Other first solvents are acyclic or cyclic acetals, ketals or ortho esters. These acyclic or cyclic acetals, ketals or ortho esters include but are not limited to: diethoxy methane, dipropoxy methane, dimethoxy ethane, diethoxy ethane, dipropoxy ethane, 2,2-dimethoxy propane, 2,2-diethoxy propane, 2,2-dipropoxy propane, 2,2-dimethyl-1,3-dioxalane, trimethyl orthoformate, triethyl orthoformate, trimethyl orthoacetate, triethyl orthoacetate, trimethyl orthobenzoate, triethyl orthobenzoate and others.

In an embodiment, the first solvent is methylal (dimethoxy methane). Methylal is a volatile solvent (b.p. 41-42.degree. C.) that has the property of softening or dissolving adherent deposits bound to various surfaces and substrates to allow their release. Compositions containing from about 0.1% to about 50.0% methylal, are useful for removing adherent deposits from surfaces and substrates.

It should be noted that any of the first solvents can be used either in combination with an exempt VOC or non-VOC carrier solvents, or as a mixture of two or more first solvents in combination with an exempt VOC or non-VOC carrier solvents, or optionally other additives, to remove adherent deposits from surfaces and substrates.

(ii) Carrier Solvent

The carrier solvent should have a lesser inherent volatility than the first solvent, to reduce the volatility of the compositions. The carrier solvent should have adequate dissolving power of its own to keep the softened or suspended released deposits in solution or suspension even after most of the other solvents have evaporated to prevent the released deposits from re-adhering.

High boiling petroleum distillates of low volatility are excellent for use as the carrier solvent. Petroleum distillates in the boiling ranges from naphtha to diesel fuel can function with varying degrees of effectiveness as a carrier solvent. Petroleum distillates can be classified as being either a VOC, or as an exempt VOC or non-VOC. When used in combination with a first solvent and optionally, one or more additives, an exempt VOC or non-VOC carrier solvent can afford a low VOC composition for removing adherent deposits from surfaces and substrates.

In an embodiment, the carrier solvent is an exempt VOC or non-VOC which belongs to the chemical family known as "petroleum hydrocarbon distillate" and has the chemical name of "Light Hydrotreated Petroleum Distillates." (LHPDs). Calumet Lubricants Company produces a typical range of LHPDs with fractionation temperatures between 400 and 600 degrees Fahrenheit. Calumet 400-500 is a trade name for one class of petroleum distillates in this fractionation range, as sold by Calumet Lubricants. Trade names of other distillates that can be used as alternate first solvents include Calprint 38 and Calprint 35.

These distillates are typical trade-named products, and substitute LHPD first solvents of this type from other manufacturers can be used in the scope of this invention. Compositions containing from about 10.0% to about 99.9% Light Hydrotreated Petroleum Distillates are useful for removing adherent deposits from surfaces and substrates, particularly metal surfaces and substrates, as well as composite plastics, ceramics, wiring, rubber hoses, painted or unpainted substrates, fiberglass, and other hard surfaces . . . .

In other embodiments, the carrier solvent is water, an exempt VOC or non-VOC. Water-based formulations may contain a first solvent and optionally one or more additives. The upper limit for a homogeneous one-phase water based formulation is a composition which contains about 55.0% water, 35.0% methylal and 10.0% of an alcoholic solvent, such as methanol, ethanol or isopropanol. Non-ionic surfactants and/or a coupling agents, can be used to emulsify water based compositions. Compositions containing from about 10.0% to about 99.9% water are useful for removing adherent deposits from surfaces and substrates.

In the embodiments of this invention intended to be used on automobile engine surfaces, water-based cleaners, including the above embodiment where the first solvent is water, are not recommended. Another embodiment of this invention without water as any of the solvents is recommended.

In other embodiments, a mixture of Light Hydrotreated Petroleum Distillates and water are used as the carrier solvents. As previously mentioned, the presence of water in the compositions may require additional additives such as alcoholic solvents, surfactants and coupling agents, for optimal performance. Compositions containing from about 0.1% to about 99.9% Light Hydrotreated Petroleum Distillates and from about 0.1% up to about 99.9% water, in combination with first solvents and additives, are useful for removing adherent deposits from surfaces and substrates.

Exempt VOC or non-VOC carrier solvents can be used either neat, in combination with one or more first solvents or additives, or as a mixture of two or more carrier solvents in combination with one or more first solvents or additives, to remove adherent deposits from surfaces and substrates.

(iii) Additives

Various additives such as second solvents, cleaners, surfactants, coupling agents, odor masking fragrances and thickeners, are optionally added to the compositions. These additives, while not generally required to remove adherent deposits, are provided for optimal cleaning performance and appeal to the consumer.

(a) Second Solvent

Although very suitable results can be obtained with the use of only a first solvent in a carrier solvent, it is frequently desirable to supplement the first solvent with a second solvent. Second solvents are selected primarily for their effectiveness in softening or dissolving adherent deposits, for their low volatility and also their low flammability.

In an embodiment, a second solvent used in combination with a first solvent, carrier solvents and other additives, are the halogenated hydrocarbon solvents. These halogenated hydrocarbon solvents include but are not limited to: trichloroethylene, perchloroethylene and 1,1,1-trichloroethane (methylchloroform) and n-propyl bromide. Compositions containing from about 0% to about 50.0 weight % n-propyl bromide are useful for removing adherent deposits from surfaces and substrates.

In another embodiment, a second solvent used is 1-methyl-2-pyrrolidinone (NMP), a solvent especially useful for water miscible applications. Compositions containing from about 0% to about 50.0% NMP are useful for removing adherent deposits from surfaces and substrates.

The second solvent may be used in these compositions in combination with any of the first solvents, carrier solvents or additives or as a mixture of two or more second solvents in combination with any of the first solvents, carrier solvents or additives to remove adherent deposits from surfaces and substrates.

(b) Cleaners

A cleaner can be added in small amounts to render the removed, undissolved adherent particles non-sticky so they can be readily wiped off. Small amounts of a cleaner tend to leave a smooth clean surface after removal of the released adherent deposits. In one embodiment, the cleaner is an alcoholic solvent. These alcohols include but are not limited to: methanol, ethanol, propanol, isopropanol, butanol and others. In another embodiment, the cleaner is mineral oil. Compositions containing from about 0% to about 20.0 weight % ethanol and/or from about 0% to about 20.0 weight % mineral oil are useful for removing adherent deposits from surfaces and substrates.

(c) Surfactants

Surfactants can be added to the compositions to assist in the release of adherent deposits from surfaces and substrates by suspension and emulsification. Non-ionic surfactants are a class of surfactants that have non-ionic but polar head group (hydrophilic) and a non-polar hydrocarbon tail (hydrophobic). These head groups are usually based on a polyoxyenthylene chain. An example is polyethyleneglycol mono[4-(1,1,3,3-tetramethylbutyl)phenylether (also known as t-octylphenoxypolyethoxyethanol) which is commercially available under the name of TRITON® X-100 (polyoxyethylene (10) isooctylphenyl ether). Other suitable non-ionic surfactants for use in these compositions include but are not limited to: polyoxyethylene ethers such as TRITON® XL-80N(C.sub.8-C.sub.10-alkyloxypolyethylene-oxy-polypropylene-oxy-ethanol), TRITON® B (benzyltrimethylammonium hydroxide), TRITON® N-101 (polyoxyethylene branched nonylphenyl ether) and TRITON® X-101, reduced (polyoxyethylene (10) isooctylphenyl ether); TRITON® X-100 (polyoxyethylene (10) isooctylphenyl ether) and TRITON® X-100, reduced (polyoxyethylene (10) isooctylcyclohexyl ether); TRITON® X-114 (polyoxyethylene (8) isooctylphenyl ether) and TRITON® X-114], reduced (polyoxyethylene (8) isooctylcyclohexyl ether); TRITON® X-405 (polyoxyethylene (40) isooctylphenyl ether) and TRITON® X-405, reduced (polyoxyethylene (40) isooctylcyclohexyl ether); sorbitan esters such as sorbitan monolaurate (SPAN® 20); sorbitan monooleate (SPAN® 80); sorbitan palmitate (SPAN® 40); sorbitan monostearate SPAN® 60; sorbitan sesquitolate SPAN® 83, sorbitan trioleate SPAN® 85, also included are polyoxyethylene oleic acid ester derivatives, polyoxyethylene lauryl amine derivatives, polyoxyethylene stearyl amine derivatives, polyoxyethylene oleyl amine derivatives, polyoxyethylene castor oil derivatives, polyoxyethylene hydrogenated castor oil derivatives, polyoxyethylene bis phenol ether derivatives, polyoxyethylene glycols, sorbitan fatty acid ester derivatives, polyoxyethylene sorbitan fatty acid ester derivatives and polyoxyethylene-polyoxypropylene derivatives and others. Compositions containing from about 0% to about 20.0 weight % TRITON® X-100 (polyoxy-ethylene (10) isooctylphenyl ether) are useful for removing adherent deposits from surfaces and substrates.

(d) Coupling Agents

Coupling is a method of compatibilizing a multiphase system that results in an increase in the degree of homogeneity of the system (J. Culver,"Selecting Coupling Agents for Multiphase Models," Modern Paint and Coatings, October, 1980, p. 102). Glycol ethers are strong couplers, have inherent cleaning power and work in combination with surfactants to pull oil and water soluble adherent deposits from the surface or substrate. Glycol ethers also couple oil soluble deposits with water and, together with the surfactant, keep the dirt suspended in the solution to prevent it from being re-deposited on the cleaned surface or substrate. Examples of coupling agents include but are not limited to: BUTYL CELLOSOLVE® or DOWANOL® EB (2-butoxyethanol or ethylene glycol monobutyl ether), DOWANOL® PnB (propylene glycol n-butyl ether), DOWANOL® DPM (dipropylene glycol methyl ether), DOWANOL® PnB (propylene glycol n-butyl ether), DOWANOL® PM (propylene glycol methyl ether), DOWANOL® DB (diethylene glycol monobutyl ether), DOWANOL® DPnB (dipropylene glycol n-butyl ether), DOWANOL® DPB (dipropylene glycol monobutyl ether).

In an embodiment, BUTYL CELLOSOLVE® (2-butoxyethanol) or DOWANOL® EB, acts to emulsify water containing compositions and is particularly useful for removing printing inks. Compositions containing from about 0% to about 20.0 weight % BUTYL CELLOSOLVE® (2-butoxyethanol) are useful for removing adherent deposits from surfaces and substrates.

(e) Fragrances

A fragrance may be used in the compositions to make the solutions more appealing to consumers. There are many common fragrance chemicals used in commercially available laundry products and cleaners to mask odors. These fragrances include but are not limited to: alpha terpineol, agrumen aldehyde light-4, allyl cyclohexane proprionate, alpha pinene, amyl cinnamic aldehyde, amyl salicylate, Belmay Lemon, Belmay Citrus, benzoin resinoid 80% in DEP, benzyl acetate, benzyl alcohol, benzyl benzoate, benzyl salicylate, beta pinene, cedarleaf, cedarwood terpenes, cinnamic alcohol, cis-3-hexenyl tiglate, citral, citrathal, citronella, citronellol, civet artificial, clary sage-western, clove stem oil, coumarin, decyl aldehyde, diethylphthalate, dihydro myrcenol, dipropylene glycol, dodecalactone, ethylene brassylate, eucalyptol, eucalyptus, eugenol, fixateur 505, frutene, galaxolide 50%, galbanum 50%, geraniol, geranium bourbon oil, geranyl nitrile, hexyl cinnamic aldehyde, hydroxycitronellal, indol, intreleven aldehyde, ionone gamma methyl, ionone methyl, iso bornyl acetate, iso cyclo citral, iso eugenol, labdanum resin, laevo menthone, lanandin, lavender, lavol, lemon cold pressed, lemongrass, d-limonene, linalool, linalyl acetate, LRG 201, methyl beta naphthyl ketone, methyl cedrylone, methyl nonyl acetaldehyde, methyl dihydro jasmonate, methyl salicylate, moskene, musk xylol, myrcenyl acetate crude, nerol, nonalactone, oakmoss 25%, octyl aldehyde, olibanum resinoid 80%, opoponax oleo resin 70%, orange oil cold pressed, orange phase oil, orange terpenes, para hydroxy phenyl butanone, para tertiary buninal, patchouli, peppermint RP, peru balsam, petitgrain, phenyl ethyl alcohol, pine oil steam distilled, rose otto synthetic, rosemary, spearmint natural, spruce, terpineol, terpinolene, terpinolene, 4-tertiary butyl cyclohexyl acetate, tetra butyl cyclohexyl acetate, tetrahydro linalool, tonalid, thyme white oil, trichloromethyl phenyl carbinyl acetate, vanillin, vertivert, vertivert acetate, ylang ylang and others.

In an embodiment, the fragrance is Belmay Lemon or Belmay Citrus. Belmay Lemon or Belmay Citrus provides a pleasant fragrance to the compositions and is commercially available. Compositions containing from about 0% to about 20.0 weight % Belmay Lemon or Belmay Citrus are useful in compositions for removing adherent deposits from surfaces and substrates.

(f) Thickeners

A thickener, or thixotropic agent, is optionally added to the composition when the formulation is to be used on a surface or substrate which is so steep that a less viscous product would flow off of the substrate to quickly, such as from a wall or a vertical sign.

Cellulose and fumed silica make excellent thickeners for these compositions. For example, METHOCEL® J12-MS (cellulose ethers), commercially available from Dow Chemical Co., is a water-soluble polymer derived from cellulose. This natural polymer is often used to thicken water based formulations, for example water based paints and cleaners. Many different grades of cellulose are commercially available (pure to technical grades) and are used depending upon their application. Fumed silica (a form of silicon dioxide) can be used either as a hydrophilic or a hydrophobic thickener and are used in many liquid systems for their viscosity control, anti-sag and anti-settling behavior. In non-polar to semi-polar systems, hydrophilic AEROSIL® 130, 200, 300, 380 (hydrophilic fumed silica with a specific surface area of 130, 200, 300 and 380 m.sup.2/g, respectively) grades are used whereas in semi-polar to polar systems, hydrophobic AEROSIL® R972 and R974 (hydrophobic fumed silica treated with DDS (dimethyldichlorosilane) with a specific surface area of 130 and 200 m.sup.2/g, respectively), AEROSIL® R812S (hydrophobic fumed silica aftertreated with HMDS based on AEROSIL® 300), AEROSIL® R202 (hydrophobic fumed silica aftertreated with polydimethylsiloxane) and AEROSIL® R805 (fumed silica aftertreated with octylsilane based on AEROSIL® 200) are used.

In an embodiment, AEROSIL® 130 (hydrophilic fumed silica with a specific surface area of 130 m.sup.2/g) is used as a thickener. In other embodiments, AEROSIL® 200, 300, 380 (hydrophilic fumed silica with a specific surface area of 130, 200, 300 and 380 m.sup.2/g, respectively), R972, R974 (hydrophobic fumed silica treated with DDS (dimethyldichlorosilane) with a specific surface area of 130 and 200 m.sup.2.mu.g, respectively), R812S (hydrophobic fumed silica aftertreated with HMDS based on AEROSIL® 300), R202 (hydrophobic fumed silica aftertreated with polydimethylsiloxane) or R805 (fumed silica aftertreated with octylsilane based on AEROSIL® 200) are used as thickeners. These thickeners are commercially available from Degussa-Huls. Compositions containing from about 0% to about 20.0 weight % AEROSIL® 130 (hydrophilic fumed silica with a specific surface area of 130 m.sup.2.mu.g)) are useful for removing adherent deposits from surfaces and substrates.

It should be noted that the component first solvents, carrier solvents and various additives can be combined in any order, to afford the desired compositions. For convenience, however, the first solvent and any of the above listed additives, are usually added to the carrier solvent.

C. VOCs and Regulations

VOCs are defined in the federal rules (40 CFR Parts 9, 59 and 51, subpart F) as any compound of carbon, excluding carbon monoxide, carbon dioxide, carbonic acid, metallic carbides or carbonates, and ammonium carbonate, which participates in atmospheric photochemical reactions.

Methane, a nonreactive compound, is not a VOC, nor are other organic chemicals with negligible photochemical reactivity. Ground level ozone (smog), formed by a chemical reaction between VOCs and oxides of nitrogen (NO.sub.x) in the presence of sunlight, presents serious air quality problems.

VOCs are emitted from diverse sources, including automobiles, chemical manufacturing facilities, gasoline/oil storage and transfer facilities, drycleaners, paint shops and other commercial and residential sources that use solvents and paint. Various consumer products are now required by federal law to have a low VOC composition.

Affected consumer products include but are not limited to: air fresheners; automobile windshield washer fluids; bathroom and tile cleaners; bug & tar removers; carburetor and choke cleaners; carpet & upholstery cleaners; cooking sprays; dusting aids; engine degreasers; fabric protectants; floor polishes; furniture polishes/waxes; general purpose cleaners; general purpose degreasers; glass cleaners; hairsprays; hair mousses; hair styling gels; household adhesives; insecticides; laundry prewashes; laundry starch products; nail polish removers; oven cleaners; shaving creams; spot removers; underarm antiperspirants; underarm deodorants and others. These products can be formulated by any means known to those of ordinary skill in the art, including but not limited to: aerosols; non-aerosols; liquids; pump sprays; solids; gels and other forms.

Listed in FIG. 1, are the Air Quality Management District (AQMD) and Environmental Protection Agency's (EPA) VOC limits for consumer products such as bug and tar removers, engine degreasers, general purpose cleaners, general purpose degreasers, laundry prewashes, spot removers and others. The maximal amounts of VOCs allowed in these products are calculated by a weight % basis and varies with the product's application and formulation's.

Low VOC compositions are those compositions, as used herein for consumer products, which contain less than or equal to the limits for VOCs as defined for the applications and formulations in FIG. 1.

FIG. 1 Air Quality Management District (AQMD) and Environmental Protection Agency's (EPA) VOC (Volatile Organic Compound) Limits VOC Content Limit Product Category (Max weight % VOC) Bug & Tar Remover 40 Carpet & Upholstery Cleaner Aerosol 7 Non-Aerosol 3 Engine Degreasers Aerosol 50 Non-Aerosol 35 General Purpose Cleaners 10 Non-Aerosols 4 General Purpose Degreasers Aerosol 50 Non-Aerosol 4 Laundry Prewash Aerosol 22 Non-Aerosol 5 Spot Remover Aerosol 25

The compositions provided herein are low VOC compositions. The total amount of VOCs present (maximum weight % VOC) in these compositions meet the standards forth by the federal government for use in the above consumer good applications.

D. Evaluation of the Ability of the Compositions to Remove Adherent Deposits from Surfaces and Substrates The compositions provided herein can be and have been tested for their ability to remove adherent deposits from surfaces and substrates by the following procedure:

1. Remove any loose materials and blot up any excess liquid with a clean white cloth or towel.
2. Apply the compositions liberally, wait up to a minute and blot with a clean white cloth or towel.
3. Physically remove the released adherent particles from the surface or substrate by wiping with a clean cloth or towel.
4. For stubborn deposits, reapply the compositions, agitate the a 15 surface or substrate with a brush and remove the released deposits by either wiping with a clean white cloth or towel, scraping with a plastic spatula or scraper, or directing a stream of water against the surface or substrate.
5. For complex stains (complex adherent deposits) like mayonnaise or lipstick, apply a combination of the compositions provided herein and a cleaner designed for either water and protein based stains, or pen, ink and dye based stains, respectively.

It should be noted that the compositions provided herein can be used in combination with any of the many known cleaners, soaps, detergents, surfactants and other consumer cleaning products to remove complex stains (complex adherent deposits) from surfaces and substrates.

E. Methods of Use

The methods of the present application are directed toward the release of adherent deposits from surface and substrates. Adherent deposits are characterized by the formation of an adherent layer that is attached to a surface or substrate. It is the purpose of these methods to eliminate, or at least to reduce the extent of attachment, so the adherent layer can be physically removed from the surface or substrate.

The previously described compositions have a multitude of uses on a variety of different surfaces and substrates. The specific uses of this invention are in the area of engine degreasers, carburetor and choke cleaners.

Surfaces and substrates include auto parts, engine surfaces and printing presses.

In practice, a composition is applied to a surface or substrate that has adhesive deposits. The composition may be applied either as a liquid solution, such as: a spray, a non-aerosol, an aerosol; or as a solid, such as: a gel, cream, paste, or an ointment. An appropriate amount of time is allowed for the composition to "soak" the adherent deposit, typically less than a minute. A release of the deposit from its surface or substrate is then observed. The released deposits are removed from the surface or substrate by a physical means such as a wiping, brushing, scraping, flushing or a rinsing with a stream of water. For convenience, the released deposits can be removed by a plastic spatula or scraper without concern about scratching or otherwise harming the surface or substrate. For difficult deposits, repeated applications of the composition and use of a high pressure water source may be necessary.

It has been found herein that virtually all adherent deposits can be divided into three distinct categories of spots and stains. These deposits can be classified as being either: 1. water and protein based, 2. petroleum and natural oil based, or 3. pen, ink, marker and dye based (including fingernail polish and correction fluid). Most commercially available cleaning products only remove one type of adherent deposit or are applicable to only a specific type of surface or substrate.

The compositions provided herein can be used alone or can be combined with other known products including but not limited to those disclosed in U.S. Pat. Nos. 4,306,989; 5,227,085; 5,250,211; 5,415,800; 5,484,487, and 6,929,702 all incorporated herein by reference in their entirety.

A major class of spot and stain removers use d-limonene as their active cleaning agent. D-limonene is the major component of the oil extracted from citrus rinds and has been used in paint solids, as a secondary cooling fluid, as an orange fragrance and in various cleaning products. Other spot and stain removers use a combination of d-limonene and kerosene (or other petroleum distillates) as the carrier solvent. The use of d-limonene in consumer products is limited because it is considered to be a VOC.

Many stain and spot removers use kerosene and other petroleum distillates as the carrier solvent. After evaporation, spot and stain removers which use petroleum distillate solvents tend to leave a greasy residue on surfaces which may either cause decolorization or act to attract dirt. Light Hydrotreated Petroleum Distillates acts like any other petroleum distillate when it is used to treat a surface: the evaporation process leaves a greasy residue which can either decolorize or attract dirt. However, when Light Hydrotreated Petroleum Distillates are used in combination with an acetal, ketal or ortho ester, the composition dries without leaving a greasy residue or decolorizing the fabric. Methylal is a particularly useful acetal, not only for its stain and spot removing properties but also for its ability to pull the carrier solvent out of a fabric.

It should be noted that the lists provided are not intended to be exhaustive, but instead to be illustrative of the wide range of utility of the described compositions and methods.

The examples included in FIG. 1 are included for illustrative purposes only and are not intended to limit the scope of the invention.

In FIG. 1, compositions A to P show a range of possible combinations of first solvents, carrier solvents and additives that are useful for the release of adherent deposits from non-porous surfaces and substrates. Compositions A to L are based on the use of Calumet 400-500, also known as Light Hydrotreated Petroleum Distillates, as the carrier solvent whereas compositions N—H use water. Example M contains a mixture of petroleum and water as the carrier solvents. To these carrier solvents, additives such as ethanol, Belmay Lemon or Belmay Citrus, TRITON® X-100 (polyoxyethylene (10) isooctylphenyl ether), BUTYL CELLOSOLVE® (2-butoxyethanol) and n-propyl bromide are optionally added for optimal adherent deposit removal performance and consumer appeal. These compositions can or have been tested for their ability to remove adherent deposits from surfaces and substrates. All compositions tested were found to be effective at removing adherent deposits.

Compositions that are particularly useful for releasing adherent deposits from surfaces and substrates include Examples E, H and 0.

In Example E, the first solvent is 6.2% methylal, the carrier solvent is 92.0% Light Hydrotreated Petroleum Distillates, the cleaner is 0.8% ethanol and the fragrance is 1.0% Belmay Citrus.

In Example H, the first solvent is 2.0% methylal, the carrier solvent is 84.0% Light Hydrotreated Petroleum Distillates, the second solvent is 8.0% n-propyl bromide, the surfactant is 5.0% TRITON® X-100 (polyoxy-ethylene (10) isooctylphenyl ether) and the fragrance is 1.0% Belmay Citrus.

In Example O, the first solvent is 11.9% methylal, the carrier solvent is 71.3% water, the cleaner is 0.8% ethanol, the surfactant is 2.7% TRITON® X-100 (polyoxyethylene (10) isooctylphenyl ether), the coupling agent is 11.9% BUTYL CELLOSOLVE® (2-butoxyethanol) and the fragrance is 1.0% Belmay Citrus.

A range of values for these components will still provided the same characteristics of low VOC and adherent deposit release. For example, based on the inventor's investigations, a range of 1% to 6.2% of methylal, a range of 92% to 97.7% LHPD and the complete absence of ethanol or fragrance is possible.

The above combinations can be adjusted to admit the use of a thixotropic agent to the composition. The thixotropic agent, typically foamed silica or cellulose, is used to enable the composition when applied to a surface to cling to the surface while it acts rather than sliding or leaking off of the surface. Spraying or applying the composition to the side of an engine block would be an example of this.

Since modifications will be apparent to those of skill in this art, it is intended that this invention be limited only by the scope of the appended claims.

What is claimed is:

1. A composition for releasing an adherent from a nonporous surface comprising:

a) 1% by weight methylal, b) 92% by weight light hydrotreated petroleum distillate, c) 0.8% by weight ethanol, d) 1% by weight citrus fragrance, and e) 5.2% a thixotropic agent, said composition possessing less than 3% VOC content and said composition when dried on the nonporous surface results in no greasy residue left behind on the nonporous surface said thixotropic agent selected from the group of cellulose and foamed silica.

2. A composition for releasing an adherent from a nonporous surface comprising:

a) 6.2% by weight methylal, b) 92% by weight light hydrotreated petroleum distillate, c) 0.8% by weight ethanol, and d) 1% by weight citrus fragrance, said composition possessing less than 3% VOC content and said composition when dried on the nonporous surface results in no greasy residue left behind on the nonporous surface.

* * * * *